United States Patent [19]

Youmans

[11] Patent Number: 4,964,775

[45] Date of Patent: Oct. 23, 1990

[54] MOBILE HOME POSITIONER

[76] Inventor: Donald W. Youmans, 427 Cedar Riverway, Sacramento, Calif. 95831

[21] Appl. No.: 200,913

[22] Filed: Jun. 1, 1988

[51] Int. Cl.[5] ..... B66F 11/00

[52] U.S. Cl. ..... 414/12; 414/498; 414/529

[58] Field of Search ..... 414/12, 495, 498, 529, 414/530, 531, 532, 533, 534, 535, 536

[56] References Cited

U.S. PATENT DOCUMENTS

| | | | |
|---|---|---|---|
| 3,743,120 | 7/1973 | Schmidt | 414/495 |
| 3,796,334 | 3/1974 | Torrey | 414/662 |
| 3,817,401 | 6/1974 | Becker | 414/12 |
| 3,958,705 | 5/1976 | Baxter | 414/12 X |
| 4,106,634 | 8/1978 | Becker | 414/495 |
| 4,200,419 | 4/1980 | Rogers, Jr. | 414/12 |

*Primary Examiner*—Robert J. Spar

*Assistant Examiner*—Janice Krizek

*Attorney, Agent, or Firm*—Bernhard Kreten

[57] ABSTRACT

A positioning device for docking one mobile home with respect to another. The positioner includes at least one trolley and preferrably two trolleys which allow the one mobile home to be adjusted with respect to its longitudinal axis and latitudinal axis. The trolley is carried on a support configured as a pair of interconnected spaced parallel "I" beams and the trolley is capable of orienting the one mobile home by rotating the mobile home about a longitudinal center line because the trolley support has two pairs of support legs, with each pair independently operated. The leg pairs are disposed at opposed extremities of the support to elevate either end of the support. A pair of centrally disposed wheels move from a retracted to a deployed configuration and are independently powered for additional maneuverability of the positioner.

10 Claims, 4 Drawing Sheets

MOBILE HOME POSITIONER

FIELD OF THE INVENTION

The following invention relates generally to an apparatus which can orient a module in three different directions: horizontally, vertically and rotate the module about an axis. More specifically, an apparatus is disclosed which positions one mobile home relatively to another. The positioning device is placed under the home to be moved and supports the home. The positioner has three degrees of freedom to allow alignment of the mobile homes relative to each other for subsequent interattachment.

BACKGROUND OF THE INVENTION

Homes having a width substantially that of one highway lane's width are fairly popular and are called mobile homes. Because these homes can be assembled at a remote site, they benefit from economy of scale !n production line manufacturing and are then transported to parks on removeable wheels. Mobile home parks, in turn, are attractive to many people because of the relative modest costs. Typically a park has at a minimum a concrete slab for automobile parking, gas and electric service and running water and sewer hook-ups.

Because mobile homes are limited !n their width by the lane width on highways, it is a common practice to take two or more such mobile homes and orient them side by side. Once the sides of the two mobile homes have been interconnected, an occupant has a residence with a sufficient width dimension to comfortably accomodate most furniture and appliance groupings.

It is the orientation process which is the subject of the instant invention. Curiously, while the prior art is fairly rich with attempts to overcome the known difficulties in orienting adjacent mobile homes, the practice in the industry is to still orient the second mobile home with respect to the first by primitive and dangerous means.

For example, the fourteen year old patent to Torrey succinctly chronicals the current state of the art of mobile home positioning in his background of the invention. The second mobile home is supported on jacks Which are pivoted to "walk" the second mobile home unit to the first. It is submitted that the Torrey device did not find commercial acceptance because, among other things, the hydraulic jacks 28, 30 which vertically orient the unit occupy too much space. In order for a mobile home positioning device to have utility for all job applications, the positioner must be capable of having an overall height of less than 12 inches when collapsed for clearance.

The two patents to Becker reflect this awareness. The later issued patent overcomes the problem of vertically extensible hydraulic cylinders by using a "pantograph" —type linkage. However, lateral translation of the mobile home (i.e. transverse to the longitudinal axis) involves movement of the entire hoist via the endless track units. Thus, the load supporting pads (having rollers) are initially fixed for the spacing of the support beams on the bottom of the mobile home and thereafter remain fixed with respect to their position on the hoist. Thus, incremental adjustment in moving the mobile unit close to the stationary mobile unit is done by an operator who cannot see the actual docking operation.

The following patents reflect the state of the art and are tendered to discharge applicant's acknowledged duty to disclose prior art. The relevance of the patents which are not discussed is less than which have been discussed hereinabove.

| | |
|---|---|
| 4,106,634 | Becker |
| 3,817,401 | Becker |
| 3,796,334 | Torrey |
| 4,417,841 | Chadwick |
| 4,569,236 | Le Boeuf |
| 4,408,739 | Buschsel |
| 4,372,572 | Verschage |
| 4,304,518 | Carder |
| 3,666,127 | Guyaux |
| 2,931,519 | Beach |
| 3,233,768 | Turturro |
| 3,411,637 | Vander Lely |
| 3,561,628 | Melin |
| 2,828,027 | Stevenson |

SUMMARY OF THE INVENTION

The instant invention is distinguished over the known prior art in that a light weight, less complex and highly portable un!t is provided which has a vertical clearance far less that the minimum design requirements in all mobile home parks known to the applicant. In addition, the structure of the instant invention facilitates placement of the positioner in extremely tight quarters when for example, spacing of longitudinally oriented support piers is as little as four feet and the setback from adjacent property !s only three feet.

Stated succinctly, the positioner according to the present invention includes a pair of trolleys carried on a trolley support. The trolley allows longitudinal adjustment of the mobile home thereon and lateral adjustment along the length of the trolley support. The trolley support in turn, is supported on the ground alternatively either by folding extensible legs which can elevate the trolley support or by a pair of wheels located remote from the distal extremities of the trolley support. When the trolley support is carried on these wheels, maneuvering in areas of limited clearance is readily achieved. The heaviest components of the positioner, such as the hydraulic power supply and associated battery, are located nearest the wheels and balanced to enhance maneuverability.

More particularly, the trolley support is formed from a pair of "I" beams oriented such that inwardly directed horizontal flange portions of each "I" beam support the trolley. Thus, the trolley is free to move along the length of the "I" beams on trolley wheels carried on the flanges. A top surface of the trolley includes a roller which permits longitudinal adjustment of the mobile unit thereon. Collectively the wheels and roller of each trolley provide two degrees of freedom in orienting the mobile home. In addition, since extensible legs are disposed at opposed extremities of the trolley support, they are independently operated to allow the trolley support to rotate about a longitudinal center line of the mobile home leveling in transverse direction of the mobile home.

These various degrees of freedom provide important maneuverability when aligning one mobile home to lot set back lines or with a second unit. Once the mobile home has been supported on the positioner, the usual alignment procedure involves trueing the floor between the adjacent mobile units. By laterally shifting one mobile home with respect to another and rotation of the moving mobile home about its longitudinal axis, the floor can then be accurately aligned, leveled and fixed in place by using the appropriate support piers under the thus moved mobile home.

OBJECTS OF THE INVENTION

Accordingly, it is a primary object of the instant invention to provide a new and useful positioner particularly in orienting a mobile home with respect to set back lines and additional mobile home units as with "double" and "triple" wide mobile homes.

It is a further object of this invention to provide a device as characterized above which is extremely maneuverable and specifically configured to accomodate mobile homes having minimal vertical clearances. Both features facilitate using the positioner when there are extremely tight quarters in which to maneuver.

A further object of the present invention contemplates providing a device as characterized above which is extremely light weight and balanced for ease in use. Thus, the device lends itself to ease in transport.

A further object of this invention contemplates providing a device as characterized above which beneficially utilizes components of standard manufacture and is configured to benefit from the economies of scale associated with mass production techniques.

A further object of this invention is to provide a device as characterized above which is extremely durable in construction and safe to use.

Viewed from one vantage point, it is an object of this invention to provide a device which orients one of a pair of mobile homes such that the side wall of one mobile home abuts a side wall of another. The device includes a trolley which underlies one mobile home and has longitudinal rollers thereon which facilitate translation of the one mobile home along its longitudinal axis and wheels to facilitate translation of the one mobile home transverse to its longitudinal axis. A trolley support underlies the trolley and includes extensible legs and wheels to be alternately used.

Viewed from another vantage point, it is an object of the present invention to provide a device as characterized above in which a mobile home positioner includes a trolley support, an extensible leg instrumentality fixed to a portion of the support to change its elevation, and a plurality of trolleys rotatably carried along the trolley support whereby the trolley moves freely along the trolley support and supports a mobile home to align the mobile home with its counterpart.

Viewed from yet another vantage point it is an object of the present invention to provide a device as characterized above which includes a method for aligning first and second mobile homes with each other, the steps including: establishing the position of the first mobile home, supporting the second mobile home on a trolley, forming the trolley to freely roll transverse to the longitudinal axis of the mobile home, fixing a trolley support and the trolley to the ground under the second mobile home, thus aligning mobile homes as to their length and sliding the second mobile home toward the first via the trolley, altering the height of the trolley support to match floors of both mobile homes, and connecting the mobile homes together including supporting the second mobile home on a plurality of piers.

These and other objects will be made manifest when considering the following detailed specification taken in conjunction with the appended drawing figures.

BRIEF DESCRIPTION OF THE DRAWING FIGURES

Figure 8:
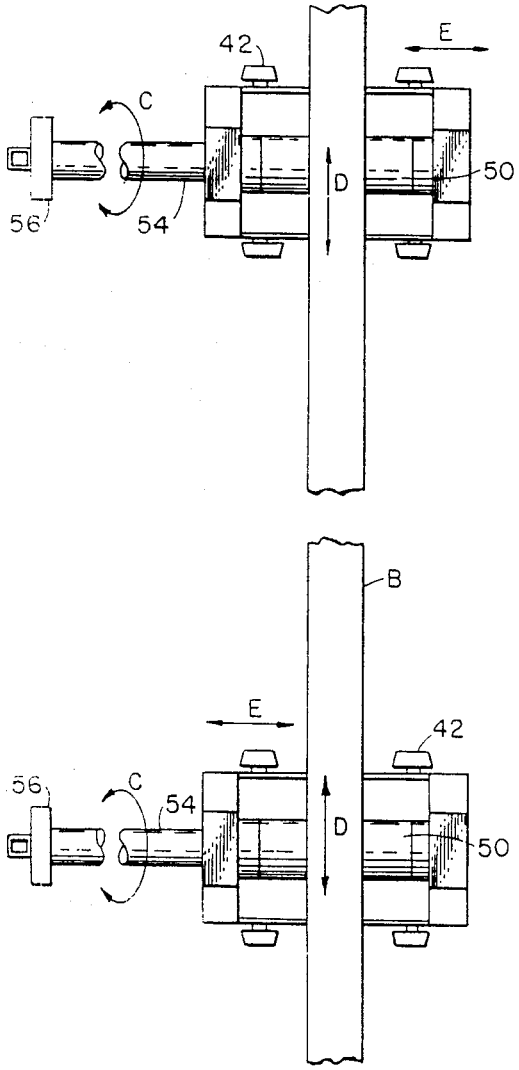

FIG. 8 diagrammatically depicts partial aspects in the operation of two of the apparatus working together from a top plan view.

Figure 1:
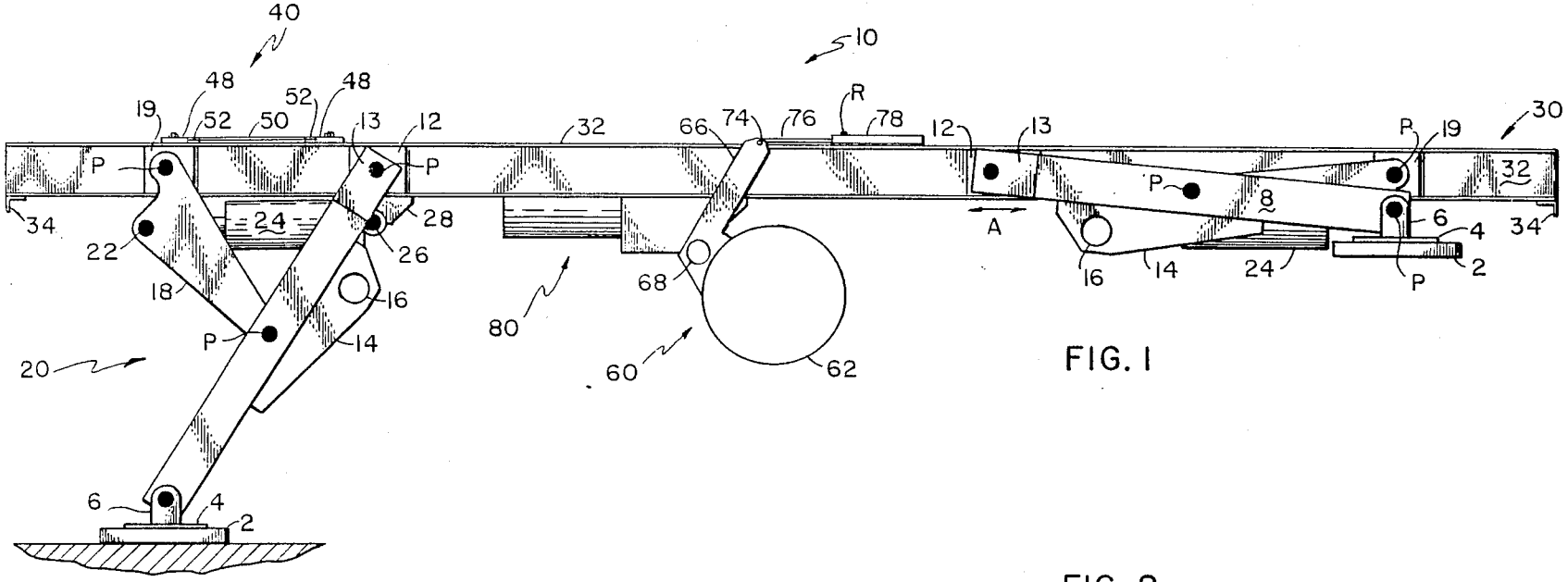
FIG. 1 is a side view of the apparatus according to the present invention with one leg in an extended, deployed position and one leg in a retracted position.
Figure 2:
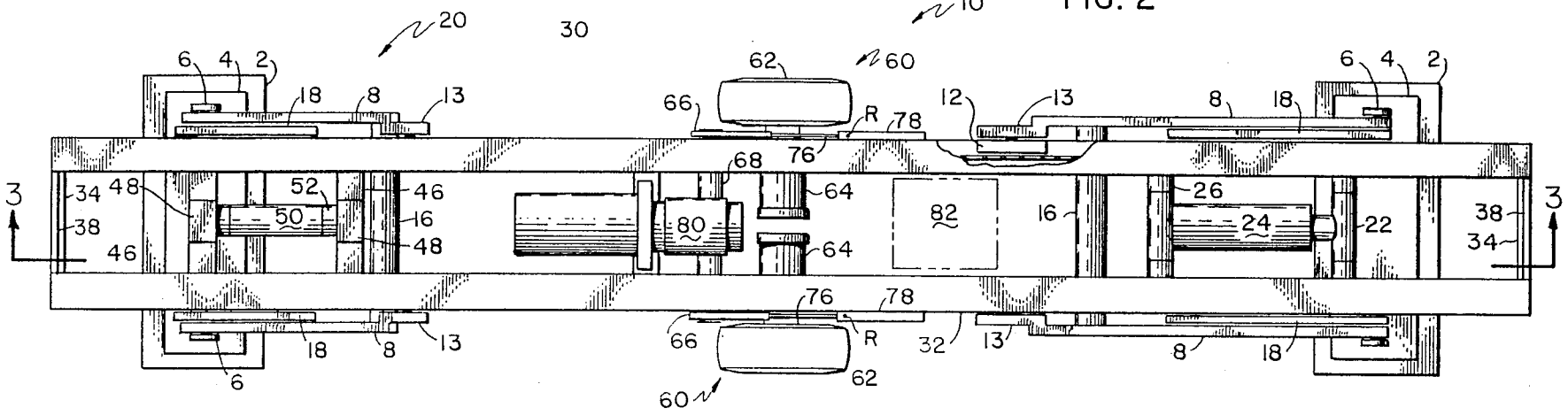
FIG. 2 is a top plan view of FIG. 1.
Figure 3:
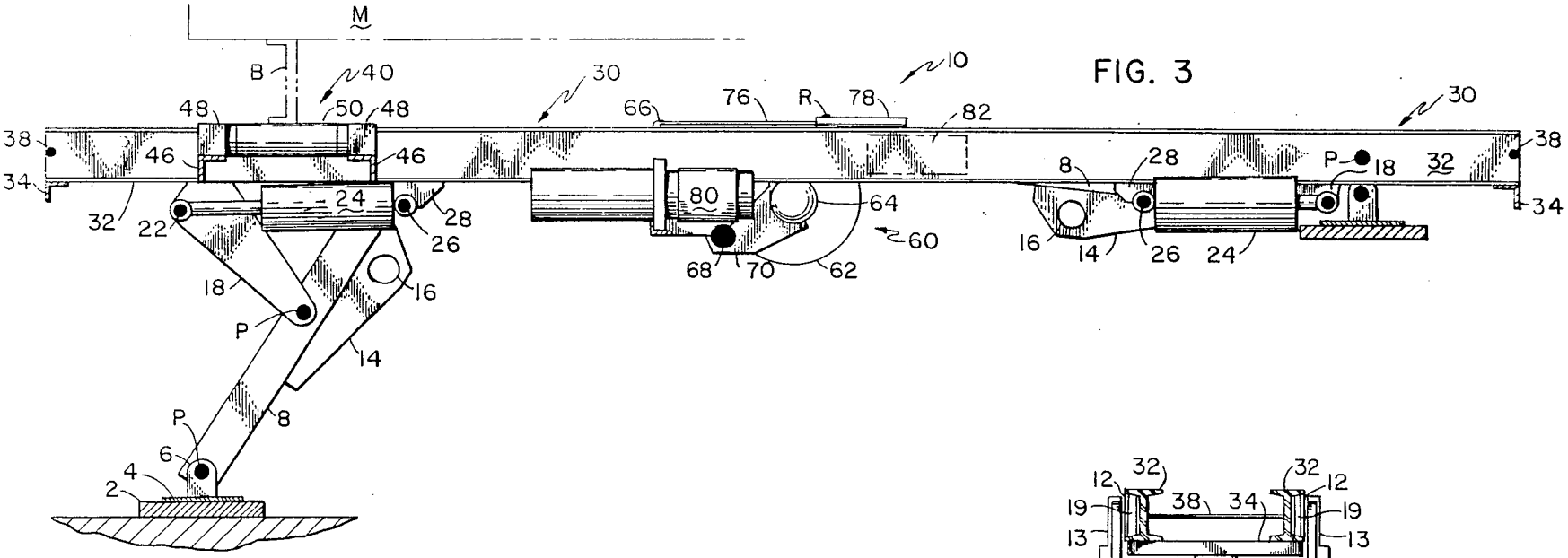
FIG. 3 is a sectional view taken along lines 3—3 of FIG. 2.
Figure 9:
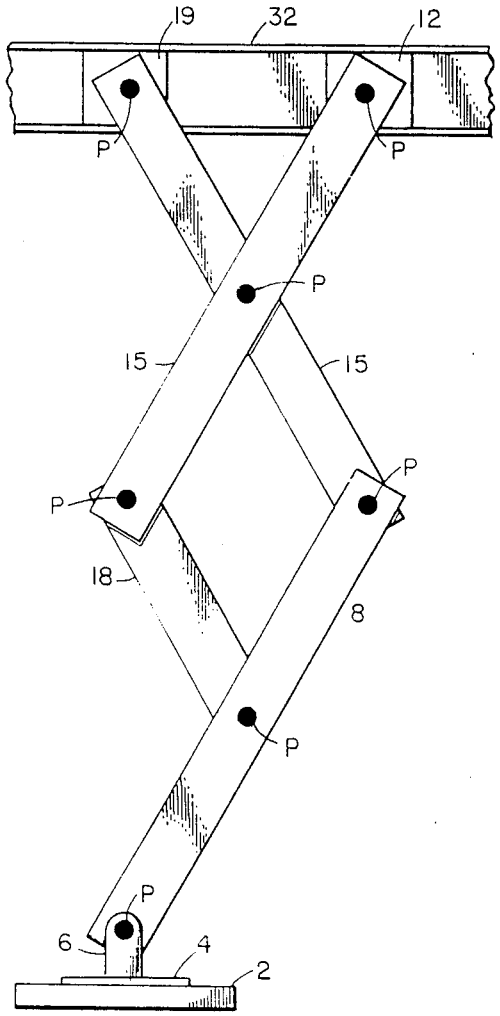

FIG. 9 shows an alternative to the extensible legs shown in FIGS. 1–3.

BRIEF DESCRIPTION OF THE PREFERRED EMBODIMENT

Referring to the drawings now, wherein like reference numerals refer to like parts throughout the various drawing figures, reference numeral 10 is directed to the mobile home positioner according to the present invention. In its essence (FIGS. 1 and 2, e.g.), the positioner 10 includes legs 20, a trolley support 30 carried on the legs 20, a trolley 40 carried on the trolley support 30, wheels 60 which support the positioner 10 when the legs 20 are retracted, and a prime mover 80 to power various instrumentalities associated with the positioner 10.

Figure 4:
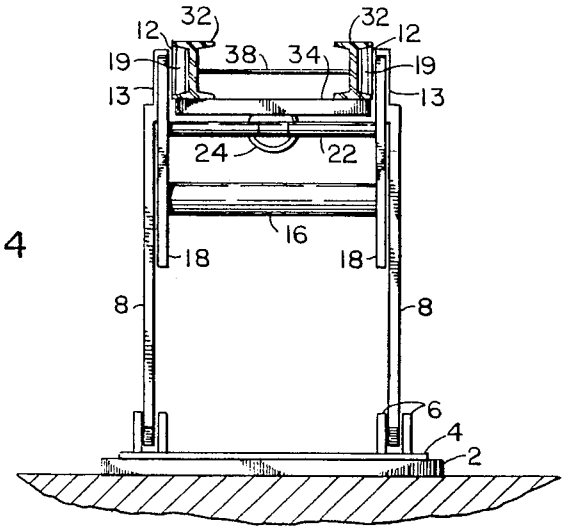
FIG. 4 is one end view of that which is shown in FIGS. 1–3.

More specifically, the positioner 10 is formed with scissor type legs 20 having the following preferred configuration. Initially, it should be noted that the trolley support 30 is formed from two "I" beams 32 oriented in spaced parallel configuration such that an open "C" shaped portion of each "I" beam channel faces the other (FIG. 4). Thus, a pair of legs 20 are provided for each "I" beam, for a total of four.

FIG. 1 reflects the configuration of one "I" beam when looking at the side of the positioner 10 and FIG. 2 is a top view. An elongate rectangular foot 2 serves as a ground support and extends between both legs at each end of the trolley support 30. The foot has an upwardly extending, substantially rectangular platform 4 which supports, at opposed longitudinal extremities, a leg support 6 configured as an upwardly extending ear. The ear 6, in turn is pivotally attached to a leg 8 with a pivot P.

Comparison between opposed ends of FIGS. 1 or 3 reflect the extreme positions of leg 8 as it moves from an extended position to a folded position. The opposed extremity of leg 8 remote from ear 6 communicates with a sliding block 12 which is constrained to operate within one of the sides of the "I" beam 32. The block 12 therefore lies between upper and lower flanges of an outwardly faced "C"-shaped channel. Thus, motion of the leg 8 from a collapsed to an extended position causes motion of the sliding block 12 along the direction of the arrow A within the "I" beam. In some instances, a spacer plate 13 is provided, pivotally attached to the sliding block 12 and welded to the leg 8 for clearance over the flange. The block 12 is formed from a class of materials having the characteristics of low friction.

Clearly, a roller could be substituted for the sliding block 12, but a more concentrated "point" load would be placed on the beam flange, requiring a stonger design. One side of each leg 8 includes a somewhat triangularly configured gusset 14 fixed to the leg which supports transverse link 16 uniting the two legs 8 at one end of the pair of "I" beams 32 (see FIGS. 2 and 3).

Each leg 8 at its approximate midpoint includes a connection with a bell crank 18 by means of pivot P. At an extremity remote from the leg 8 the bell crank 18 has a pivotal connection to a pad 19 of similar rectangular configuration as the sliding block 12, but the pad 19 is fixed within the "C" shaped channel portion of the "I" beam 32. As shown in FIG. 3, the bell crank 18 is powered by a hydraulic cylinder 24 which is pivoted to the bell crank 18 by means of a transverse driven rod 22 which extends between a pair of bell cranks, one bell crank per "I" beam at each end. An opposed extremity of the hydraulic cylinder 24 includes a cylinder support rod 26 interconnecting the pair of "I" beams 32. As shown in FIGS. 1 and 3, the cylinder support rod 26 fastens to a depending rod support flange 28 carried on a lower surface of each "I" beam 32.

FIG. 9 reflects a second leg version where the top most extremities of the leg 8 and bell crank 18 each connected to an extension link 15 which, in turn connects to the slide 12 and block 19. This allows the positioner 10 to achieve greater height when being raised.

With respect to the trolley support 30, FIGS. 1 through 3 reflect the pair of "I" beams 32 interconnected by transverse beam supports 34 at opposed distal extremities. Just above each transverse beam support 34, a trolley retainer rod 38 is fixed between the pair of "I" beams 32.

Figure 5:
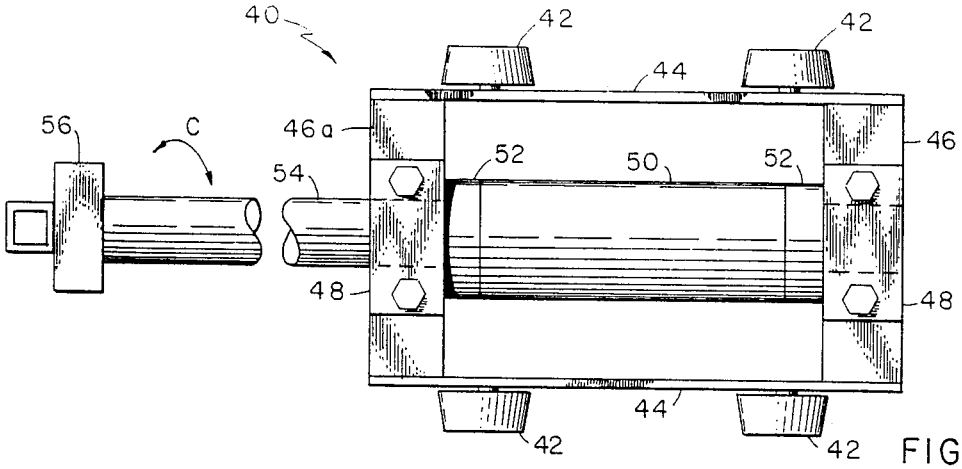
FIG. 5 is a top plan view of the trolley system shown in FIGS. 1–3.
Figure 6:
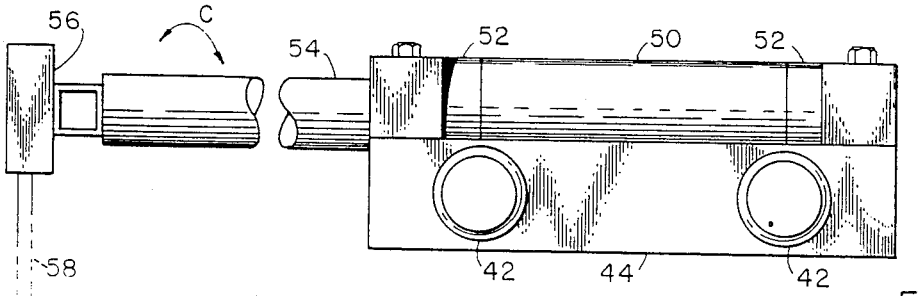
FIG. 6 is a side view of that which is shown in FIG. 5.
Figure 7:
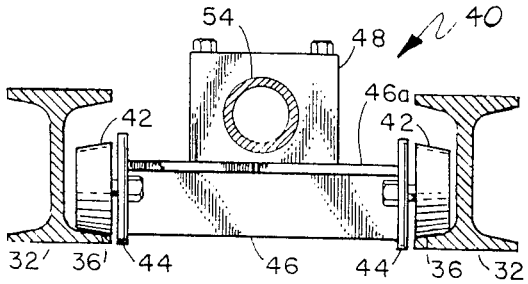
FIG. 7 is an end view of that which is shown in FIGS. 5 and 6.

More specifically, the trolley retainer rod 38 retains the trolley 40 as shown when viewing FIGS. 4 through 7. Each trolley 40 includes two pairs of wheels 42 with one pair each carried on lower inner flange 36 of the "I" beam 32 as shown in FIG. 7. Thus, the trolley 40 can move along the length of the pair of "I" beams 32 and is constrained from running off the end of the "I" beams by means of the trolley retainer rod 38 which abuts against side plates 44 of trolley 40. However, the trolleys are therefore removeable by merely lifting the trolley above the obstruction defined by the rod 38.

The trolley 40 shown in FIG. 7 includes two side plates 44 and each supports a pair of wheels 42. The side plates 44 are oriented in parallel and the side plates 44 are interconnected by angle irons 46 at extremities of the side plates 44. Thus, a substantially rectangular framework is provided. A top surface 46*a* of each angle iron 46 supports a longitudinal roller 50 by means of pillow blocks 48 carried on top surfaces 46*a* of the angle irons 46. It should be noted that the angle irons 46 could be replaced with solid bar stock to provide a lower profile, if desired.

Each longitudinal roller 50 has, at distal extremities adjacent the pillow blocks, collars 52 which serve as clamps when a pipe 54 is placed within the hollow of the roller 50 and collar 52 assembly. Thus, rotation of a pipe 54 will cause rotation of the roller 50. FIGS. 5 and 6 reflect the purpose for the pipe 54. As shown, a free end of the pipe 54 terminates in a cruciform drive socket 56 having two radially extending through sockets of substantially square configuration. Thus, a roller drive 58 (such as a "crowbar") when fitted into any of the sockets 56, will cause rotation of the pipe 54 in the direction desired, shown by arrow "C". Since the pipe 54 is fixed to the roller 50 by the collar 52, rotation of the roller 50 occurs.

It should be pointed out that these rollers could be powered by a hydraulic system such as the one to be described which powers the hydraulic cylinders 24. It should be noted that these rollers 50 support the channel shaped beams B which underlie the mobile unit M (FIG. 3). When advancing the mobile unit along its longitudinal axis, a hydraulic system does not provide the sensitivity when a snag on the mobile home is encountered, and thus, in some instances with a powered roller, driving the roller may cause unwanted motion of the positioner 10 rather than longitudinal translation of the mobile unit. That is to say, using a powered system may cause the positioner 10 to tip over and create a danger. With the manual drive, sufficient leverage exists to incrementally advance the mobile home along the longitudinal axis. In addition, it should be pointed out that the wheels 42 which move along the length of the "I" beams are not powered either, although they could be. It is stipulated that the docking procedure between the pair of mobile units is a delicate operation, and should be effected with incremental advancement and under close supervision. By using a "come-a-long" (ratchet hoist) between the two mobile units, the lateral adjustment can be made precisely.

FIGS. 1-3 reveal a wheel system 60. Each wheel system 60 includes a pair of tires 62 underlying but offset from each "I" beam 32. The tires 62 are driven by independent hydraulic drives 64 and are supported on the "I" beam by means of a strut 66. As shown, the strut 66 allows pivotal motion about a strut axle 68 to allow movement of the wheels 60 from a retracted position (FIG. 3) to an extended, deployed configuration (FIG. 1) when the wheels are to be used. The strut 66 supports a wheel by means of a strut fork 70 which straddles a portion of the hydraulic drive 64. A free end 74 of the strut 66 remote from the strut fork 70 is connected to a linkage to effect deployment of the tire 62 from a retracted to an extended position. As shown, the free end 74 is connected to one of a pair of concentric sleeves 76 and 78, another of which is connected to the "I" beam 32. The outer sleeve reciprocates along the length of the inner sleeve 76, and the tire 62 can be retained in either a retracted or a deployed configuration. The tire 62 is fixed between the two sleeves by means of a retainer R passing through aligned transverse bores on both the sleeves.

FIGS. 1-3 reflect the hydraulic system and certain details. As shown, a hydraulic drive 80 is provided on one side of the wheel assembly 60, and a battery 82 on an opposed side. Since the wheels are centrally located on the positioner 10, placing drive 80 and battery 82 on opposed sides of the wheels provides balancing for ease of maneuverability of the positioner 10. Also note that since there is symmetry with respect to the legs, hydraulic cylinders 24 etc., the remainder of the positioner 10 is substantially balanced so that a set of two wheels will allow the device to move with minimal effort. By merely using two wheels at the center, the device can effectively pivot about one wheel. Each wheel is independently operated by a separate motor to effect this microadjustment and positioning. Thus, a separate circuit extends from the hydraulic drive 80 to each wheel. In addition, separate circuits are provided for each of the hydraulic cylinders 24 to provide independent action of the legs at each end of the positioner 10.

In use and operation, the positioner is placed under the mobile home which is to dock with a stationary mobile home. Preferrably the positioner is placed at one end of the mobile home M. The wheels are retracted before placing positioner under mobile home in order to provide for minimum height of the positioner. Initially, each trolley is oriented to underly one of the support beams B associated with the mobile home M. Next, the legs are extended to support the mobile home M so that the positioner is load bearing. Adjustments with respect to the longitudinal axis of the mobile home M can be effected by means of the rollers 50 and its manipulation through the roller drive 58 and drive pipe 54. It is preferred that all of the rollers on one positioner be coupled for simultaneous movement is necessary. Once the longitudinal adjustment of the mobile home has been made, a "come-a-long" is connected between the two mobile homes to allow lateral adjustment therebetween. The trolley wheels 42 provide ease in lateral adjustment. The legs of the positioner closest to the mobile home are adjusted to provide alignment to the floors of the adjacent mobile homes and the legs remote from the interconnection between the mobile homes also are manipulated to provide a level floor surface. Typically, the outermost legs are lift at a slightly lower elevation until the edges of the floor between the two mobile homes are in alignment and then the outboard legs rotate the mobile home upwardly to true the floor. When thusly aligned, the mobile homes are interconnected and the newly arrived mobile home is supported on piers. Typically, the orientation occurs at each end of the mobile home, individually and not as a simultaneous operation. However, both ends of the mobile home can be positioned simultaneously by the use of two positioners 10, as shown schematically in FIG. 8. Arrow C shows rotation of shaft 54 moving beam B of mobile home in the direction of the arrow D, because of roller 50. Arrow E shows the direction of motion for beam B because of the trolley wheels 42. Recall that because legs 8 are independently operated, the mobile home also can be oriented by rotation.

Moreover, having thus described the invention it should be apparent that numerous structural modifications and adaptations may be resorted to without departing from the scope and fair meaning of the instant invention characterized hereinabove and as defined hereinbelow in the claims.

I claim:

1. A positioner for a mobile home or the like comprising in combination:

trolley support means, extensible leg means integrally connected to a lower portion of said trolley support means to change its elevation, a plurality of trolley means rotatably carried along said trolley support means whereby said trolley means moves freely along said trolley support means while supporting the mobile home to align the mobile home with another mobile home.

wherein said trolley means includes a first set of wheels rotatably constrained on said trolley support means whereby translation of said trolley means along the length of said trolley support means is effected, roller means carried on said trolley means to afford translation of the mobile home in a direction transverse to the direction of motion of said trolley wheels, wherein said trolley support means is formed from a pair of laterally spaced parallel "I" beams oriented such that inwardly facing C-shaped portions of said "I" beams face each other.

said trolley means wheels are carried on said trolley support means "I" beam, said "I" beams are interconnected by transverse beam supports, wherein said extensible leg means depends from a side portion of said trolley support means and includes a first leg extending from an outer face of said "I" beam and carried thereon by means of a sliding block which moves along outwardly faced C-shaped channel portions of said "I" beam, and end of said leg remote from said sliding block is interconnected to another leg by means of a transverse platform which in turn is supported by an underlying foot, said leg remote end is pivotally attached to said platform through an ear, and a bell crank extends from said leg to a lower surface of each said "I" beam, and is interconnected to another bell crank by a transverse rod and is driven by a hydraulic cylinder which depends from a lower portion of said "I" beams by a cylinder support rod.

2. A device to orient a pair of mobile homes such that a side wall of one mobile home abuts with a side wall of the other, comprising in combination:

a trolley which underlies one mobile home having longitudinal roller means which facilitates translation of the one mobile home along its longitudinal axis and latitudinal wheel means to facilitate translation of the one mobile home in a direction transverse to its longitudinal axis, a trolley support means underlying said trolley and including a latitudinal wheel guide for said trolley wherein said latitudinal wheel guide includes a plurality of wheels supported on a bottom surface of said trolley support means having means to deploy or retract said latitudinal wheel guide, wherein said trolley wheel means includes a first set of wheels rotatably constrained on said trolley support guide means whereby translation of said trolley means along the length of said trolley support means is effected, said roller means carried on said trolley means afford translation of the mobile home in a direction transverse to the direction of motion of said trolley wheels, wherein said trolley support means is formed from a pair of laterally spaced parallel "I" beams oriented such that inwardly facing C-shaped portions of said "I" beams face each other, said trolley means wheels are carried on a lower inwardly directed flange of said trolley support means "I" beam, said "I" beams are interconnected, wherein extensible leg means depend from said trolley support means and includes a first leg extending from each opposed outer face of said "I" beams and carried thereon by means of a sliding block which moves along each outwardly faced C-shaped channel portion of said "I" beam, an end of each said leg remote from said sliding block is interconnected with another leg by means of a transverse platform which in turn is supported by an underlying foot, said ends of said legs are each pivotally attached to said platform through an ear, and a bell crank extends from said leg to a lower surface of each said "I" beam, and is interconnected by a transverse rod driven by a hydraulic cylinder which depends from a lower portion of said "I" beams by a cylinder support rod.

3. A positioner for a mobile home or the like, comprising in combination:

trolley support means, extensible leg means fixed to a portion of said trolley support means to change its elevation, and a plurality of trolley means rotatably carried along said trolley support means whereby said trolley means moves freely along said trolley support means while supporting the mobile home to align the mobile home with another mobile home, wherein said trolley means includes a first set of wheels rotatably constrained on said trolley support means whereby translation of said trolley means along the length of said trolley support means is effected, and roller means carried on said trolley means to afford translation of the mobile home in a direction transverse to the direction of motion of said trolley wheels, wherein said trolley support means is formed from a pair of laterally spaced parallel "I" beams oriented such that inwardly facing C-shaped portions of said "I" beams face each other, said trolley means wheels are carried on a lower inwardly directed flange of said trolley support means "I" beam, said "I" beams are interconnected by transverse beam supports, wherein said extensible leg means depends from a side portion of said trolley support means and includes a first leg extending from an outer face of said "I" beam and carried thereon by means of a sliding block which moves along outwardly faced C-shaped channel portions of said "I" beam, an end of said leg remote from said sliding block is interconnected to another leg by means of a transverse platform which in turn is supported by an underlying foot, said leg remote is pivotally attached to said platform through an ear, and a bell crank extends from said leg to a lower surface of each said "I" beam, and is interconnected to another bell crank by a transverse rod and is driven by a hydraulic cylinder which depends from a lower portion of said "I" beams by a cylinder support rod.

4. The positioner of claim 3 wherein said trolley means is formed from two side plates and upon both said side plates one pair of wheels are connected, said pair of wheels are each supported on said "I" beam inwardly directed flange, a pair of angle irons interconnect said side plates, said angle iron has a top horizontal surface upon which a pair of pillow blocks are spaced, said pillow blocks support said roller, and clamping means are on said roller for removable reception of a drive means within a central core thereof.

5. The positioner of claim 4 wherein said drive means includes an elongate pipe constricted within said roller by said clamping means, said pipe having a distal extremity remote from said roller provided with a cruciform drive socket, whereby leverage obtained within one socket of said cruciform drive socket can rotate said roller.

6. A device to orient a pair of mobile homes such that a side wall of one mobile home abuts with a side wall of the other, comprising in combination:

a trolley which underlies one mobile home having longitudinal roller means which facilitates translation of the one mobile home along its longitudinal axis and latitudinal wheel means to facilitate translation of the one mobile home in a direction transverse to its longitudinal axis, a trolley support means underlying said trolley and including a latitudinal wheel guide for said trolley, wherein said trolley wheel means includes a first set of wheels rotatably constrained on said trolley support guide means whereby translation of said trolley means along the length of said trolley support means is effected, and said roller means carried on said trolley means afford translation of the mobile home in a direction transverse to the direction of motion of said trolley wheels, wherein said trolley support means is formed form a pair of laterally spaced parallel "I" beams oriented such that inwardly facing C-shaped portions of said "I" beams face each other, said trolley wheel means are carried on a lower inwardly directed flange of said trolley support means "I" beam, said "I" beams are interconnected by transverse beam supports, wherein extensible leg means depend from said trolley support means and includes a first leg extending from each opposed outer face of said "I" beams and carried thereon by means of a sliding block which moves along each outwardly faced C-shaped channel portion of said "I" beam, an end of each said leg remote from said sliding block is interconnected with another leg by means of a transverse platform which in turn is supported by an underlying foot, said ends of said legs are each pivotally attached to said platform through an ear, and a bell crank extends from said leg to a lower surface of each said "I" beam, and is interconnected to another bell crank by a transverse rod driven by a hydraulic cylinder which depends from a lower portion of said "I" beams by a cylinder support rod.

7. The device of claim 6 wherein said trolley means is formed from two side plates through which two pairs of wheels are connected, one pair of wheels each supported on said "I" beam C-shaped inwardly facing flange, a pair of bars interconnecting said side plates, said bars having a top horizontal surface upon which a pair of pillow blocks are spaced, said pillow blocks are supporting said roller and clamping means on said roller for removeable reception within a central core thereof for a drive means.

8. The device of claim 7 wherein said drive means includes an elongate pipe constricted within said roller by said clamps having a distal extremity remote from said roller provided with a cruciform drive socket, whereby one socket of said cruciform drive socket can rotate said roller.

9. A positioner for a mobile home or the like, comprising in combination:

trolley support means, extensible leg means fixed to a portion of said trolley support means to change its elevation, and a plurality of trolley means rotatably carried along said trolley support means whereby said trolley means moves freely along said trolley support means while supporting the mobile home to align the mobile home with another mobile home, wherein said extensible leg means depend from a side portion of said trolley support means and includes a first leg extending from an outer face of an "I" beam and carried thereon by means of a sliding block which moves along outwardly faced C-shaped channel portions of said "I" beam.

an end of said leg remote from said sliding block is interconnected to another leg by means of a transverse platform which in turn is supported by an underlying foot, said leg remote end is pivotally attached to said platform through an ear, and a bell crank extends from said leg to a lower surface of each said "I" beam, and is interconnected to another bell crank by a transverse rod and is driven by a hydraulic cylinder which depends from a lower portion of said "I" beams by a cylinder support rod.

10. A device to orient a pair of mobile homes such that a side wall of one mobile home abuts with a side wall of the other, comprising in combination:

a trolley which underlies one mobile home having longitudinal roller means which facilitates translation of the one mobile home along its longitudinal axis and latitudinal wheel means to facilitate translation of the one mobile home in a direction transverse to its longitudinal axis, a trolley support means underlying said trolley and including a latitudinal wheel guide for said trolley, wherein extensible leg means depend from said trolley support means and includes a first leg extending from each opposed outer face of a pair of "I" beams and carried thereon by means of a sliding block which moves along each outwardly faced C-shaped channel portion of said "I" beam, an end of each said leg remote from said sliding block is interconnected with another leg by means of transverse platform which in turn is supported by an underlying foot, said ends of said legs are each pivotally attached to said platform through an ear, and a bell crank extends from said leg to a lower surface of each said "I" beam, and is interconnected by a transverse rod driven by a hydraulic cylinder which depends from a lower portion of said "I" beams by a cylinder support rod.

* * * * *